US006011568A

United States Patent [19]

Ngo

[11] Patent Number: 6,011,568

[45] Date of Patent: Jan. 4, 2000

[54] PRINTER PROCESSOR SHEET FILM REGISTRATION AND TRANSFER MECHANISM

[75] Inventor: Giang T. Ngo, Hilton, N.Y.

[73] Assignee: Eastman Kodak Company, Rochester, N.Y.

[21] Appl. No.: 08/979,314

[22] Filed: Nov. 26, 1997

[51] Int. Cl.[7] ..... B41J 15/02

[52] U.S. Cl. ..... 347/116; 347/262; 347/264; 346/107.6

[58] Field of Search ..... 347/116, 262, 347/264; 346/107.6, 116, 136; 226/181, 108; 396/618

[56] References Cited

U.S. PATENT DOCUMENTS 4,324,480 4/1982 Nomura et al. ..... 396/618
4,909,426 3/1990 Crowley et al. ..... 226/108

*Primary Examiner*—N. Le
*Assistant Examiner*—Hai C. Pham
*Attorney, Agent, or Firm*—William F. Noval

[57] ABSTRACT

In a laser imaging system including a laser printer for exposing photothermographic sheet film to a medical image and a coupled thermal processor for thermally processing exposed photothermographic film, the processor having a thermal processing section, a sheet film registration and transfer mechanism comprising: a first film shock absorbing and deflector mechanism for absorbing the energy of exposed film as it moves vertically out of the printer and for then deflecting the film substantially horizontally; a film transfer mechanism for transferring the film between the printer and the processor along a substantially horizontal path; and a second film shock absorbing and deflector mechanism for absorbing the energy of the film as it is transferred along the horizontal path and for deflecting the film substantially vertically into the thermal processing section of the processor.

4 Claims, 5 Drawing Sheets

PRINTER PROCESSOR SHEET FILM REGISTRATION AND TRANSFER MECHANISM

FIELD OF THE INVENTION

This invention relates in general to sheet film transport mechanisms and more particularly to a sheet film registration and transfer mechanism for film sheets transported between a laser printer and a thermal processor.

BACKGROUND OF THE INVENTION

Conventional medical image laser printers expose silver halide film which must be chemically processed using liquid chemicals. There is a need to eliminate wet processing for environmental, cost of installation, and ease of maintenance factors. One way to fulfill this need in medical image laser printer systems is to use photothermographic ("dry silver") film which is thermally processed. A need arises for a mechanism to transfer film from the printer to a heated drum thermal processing unit in a way which ensures good film registration relative to the processor mechanism and enhances processing uniformity and film path accessibility.

SUMMARY OF THE INVENTION

According to the present invention, there is provided a solution to the problems of the prior art According to a feature of the present invention, there is provided a laser imaging system including a laser printer for exposing photothermographic sheet film to a medical image and a coupled thermal processor for thermally processing exposed photothermographic film, the processor having a thermal processing section, a sheet film registration and transfer mechanism comprising: a first film shock absorbing and deflector mechanism for absorbing the energy of exposed film as it moves vertically out of the printer and for then deflecting the film substantially horizontally; a film transfer mechanism for transferring the film between the printer and the processor along a substantially horizontal path; and a second film shock absorbing and deflector mechanism for absorbing the energy of the film as it is transferred along the horizontal path and for deflecting the film substantially vertically into the thermal processing section of the processor.

ADVANTAGEOUS EFFECT OF THE INVENTION

The invention has the following advantages.

1. It is robust, simple, reliable and efficient
2. Modular design.
3. Complete rack, removable, with drop in engagement drive train.
4. No electrical, mechanical or hard mount connections are required.
5. No on board sensor or harness.
6. A simple clutch control for entire mechanism.
7. No drive motor is required.
8. Entire rack assembly pivots for access film jam clearance.

DETAILED DESCRIPTION OF THE INVENTION

Figure 1:
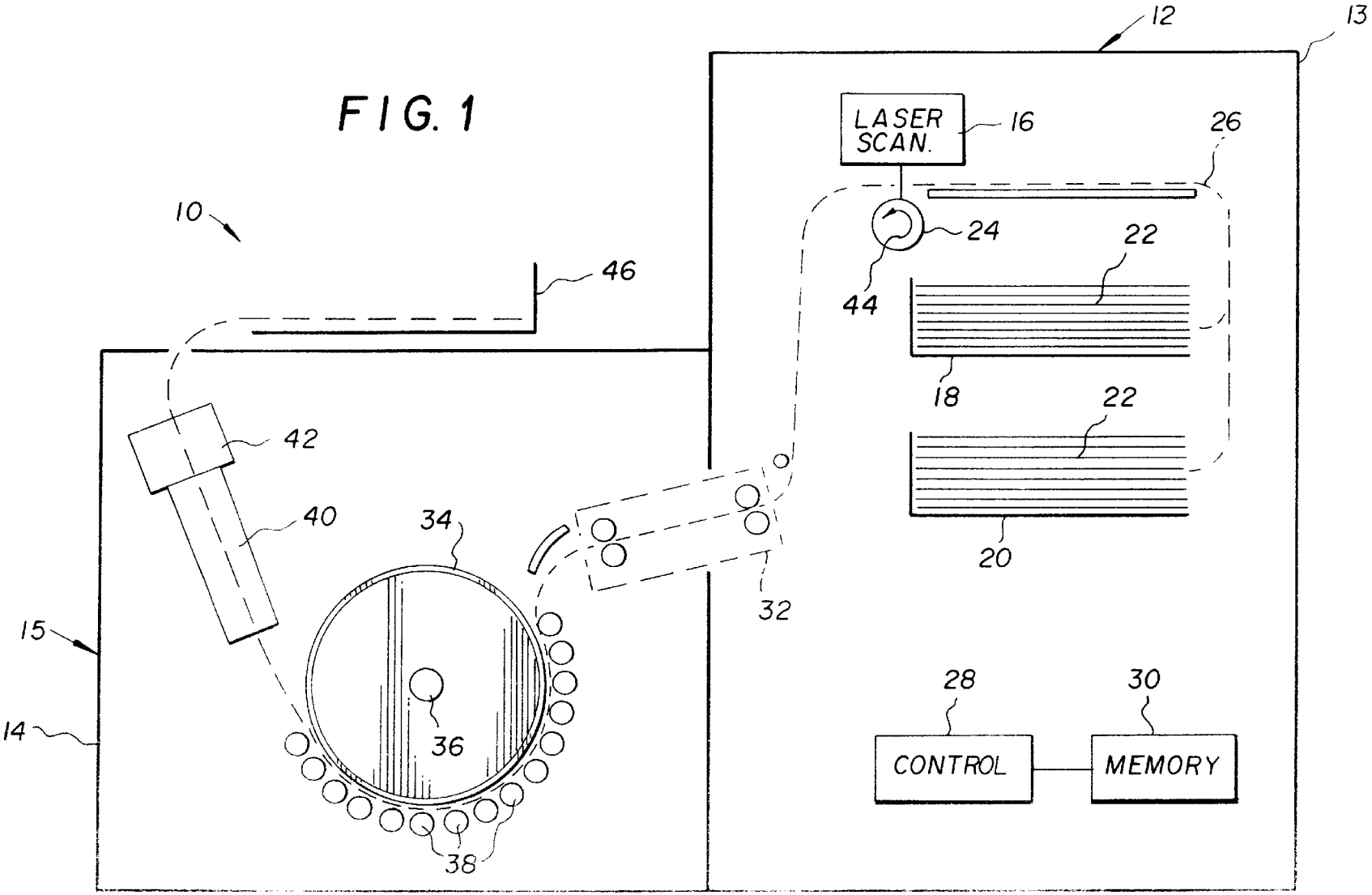
FIG. 1 is a diagrammatic view of laser imaging apparatus incorporating the present invention.
Figure 2:
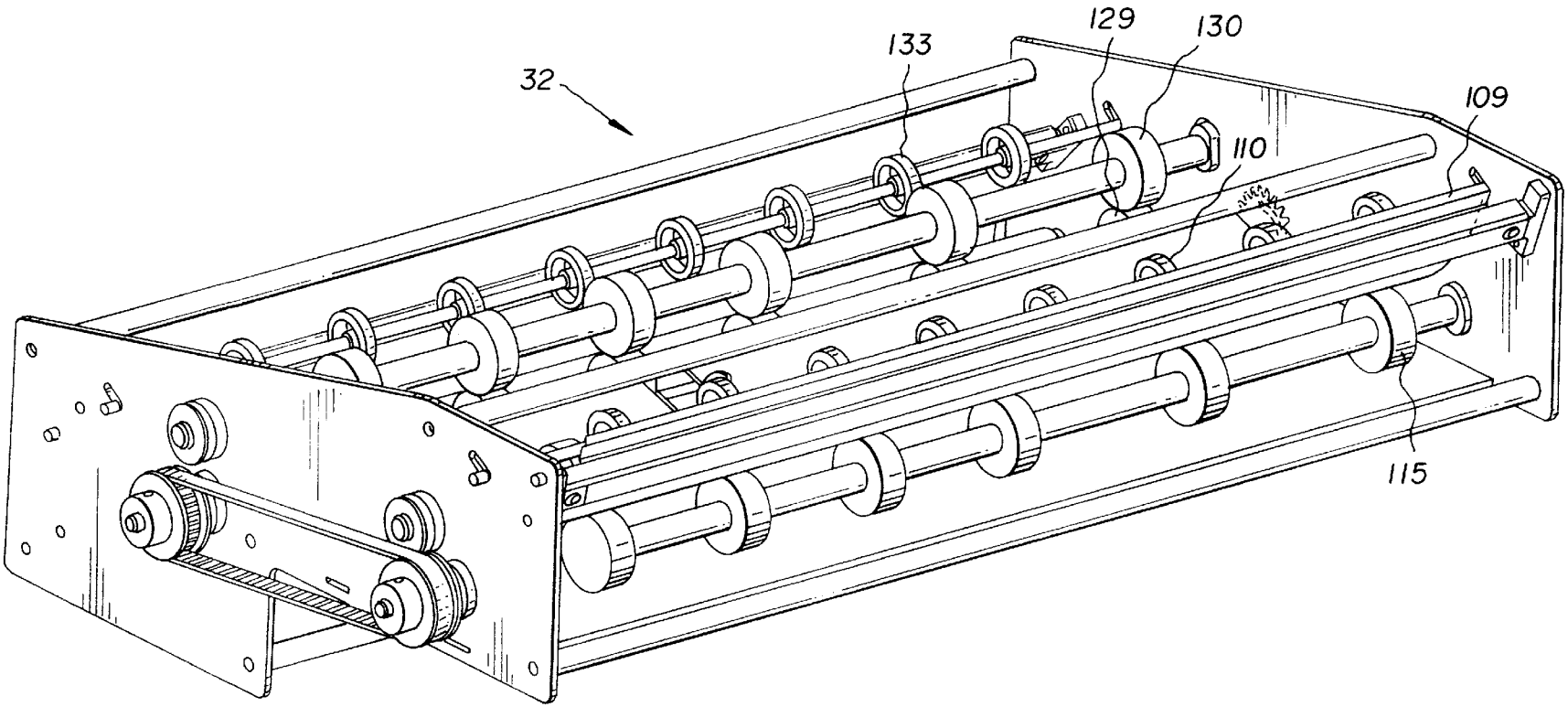
FIG. 2 is a perspective view of an embodiment of the present invention.

Referring now to FIG. 1, there is shown laser imaging apparatus incorporating the present invention. As shown, apparatus 10 includes a laser printer 12 and processor 14. Although printer 12 and processor 14 are shown as housed in separate units, it will be understood that they could be integrated into one housing. In the specific application described here, printer 12 is a medical image laser printer for printing medical images on photothermographic film which is thermally processed by thermal processor 14. The medical images printed by printer 12 can be derived from medical image sources, such as medical image diagnostic scanners (MRI, CT, US, PET), direct digital radiography, computed radiography, digitized medical image media (film, paper), and archived medical images.

Printer 12 includes printer housing 13, laser scanner 16, supplies 18,20 for unexposed photothermographic film 22, a slow scan drum 24, film path 26, control 28, memory 30, printer/processor film registration and transfer mechanism 32. Processor 14 includes processor housing 15, mechanism 32, drum 34 heated by lamp 36, hold-down rollers 38 located around a segment of the periphery of drum 34, exposed film cooling assembly 40, densitometer 42, and output tray 46.

Apparatus 10 operates in general as follows. A medical image stored in memory 30 modulates the laser beam produced by the laser of scanner 16. The modulated laser beam is repetitively scanned in a fast or line scan direction to expose photothermographic film 22. Film 22 is moved in a slow or page scan direction by slow scan drum 24 which rotates in the direction of arrow 44. Unexposed photothermographic film 22, located in supplies 18,20, is moved along film path 26 to slow scan drum 24. A medical image is raster scanned onto film 22 through the cooperative operation of scanner 16 and drum 24.

After film 22 has been exposed, it is transported along path 26 to processor 14 by mechanism 32. The exposed film 22 is developed by passing it over heated drum 34 to which it is held by rollers 38. After development, the film 22 is cooled in film cooling assembly 40. Densitometer 42 reads the density of control patches at the front edge of film 22 to maintain calibration of the laser imaging apparatus 10. The cooled film 22 is output to tray 46 where it can be removed by a user.

Referring now to FIGS. 2–6, there will be described an embodiment of the printer/processor sheet film registration and transfer mechanism of the present invention. As shown, mechanism 32 includes shock absorbing section 113 having film guide shoe 109, puck rollers 110 mounted on steel shaft 160 which slides in inclined slot 111. Drive roller 115 and pressure roller 117 form a film registration nip 119 and drive roller 129 and pressure roller 130 form a nip 161. Mechanism 32 also includes film guide 120 between roller pairs 115,117 and 129,130, film sensor actuator 125 with film path sensor flag 127, optical sensor 165, puck rollers 133 on shaft 162 which slides in slot 145, film guide shoe 139 and idler rollers 141,142.

Figure 6:
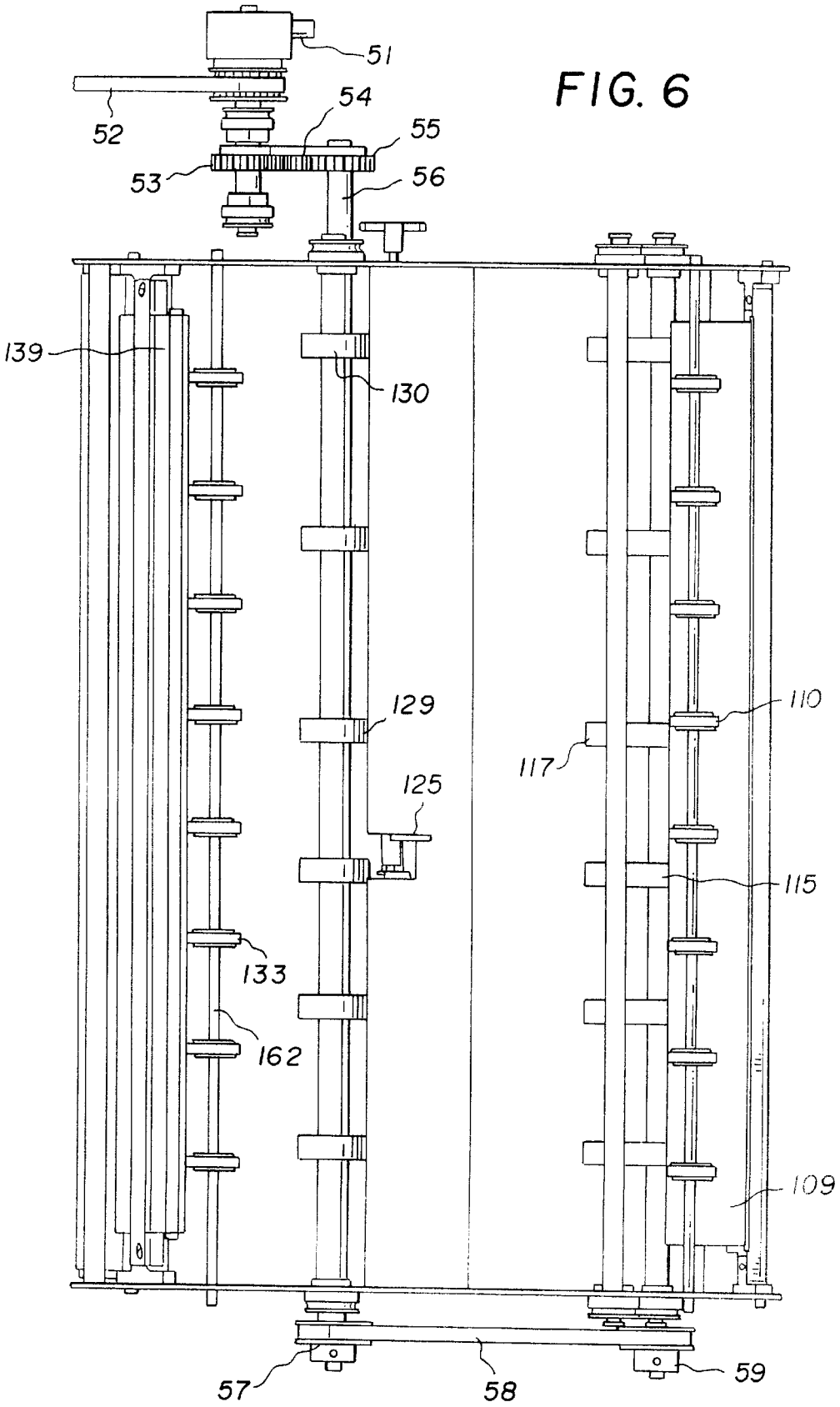
FIG. 6 is a plan diagrammatic view of the embodiment of FIG. 2 showing the film registration mechanism clutch control.

As shown in FIG. 6, the drive for mechanism 32 includes continuously driven main driving timing belt 52, electric clutch 51, gears 53,54,55, driven timing belt 58 trained about pulleys 57,58.

Figures 3, 4:
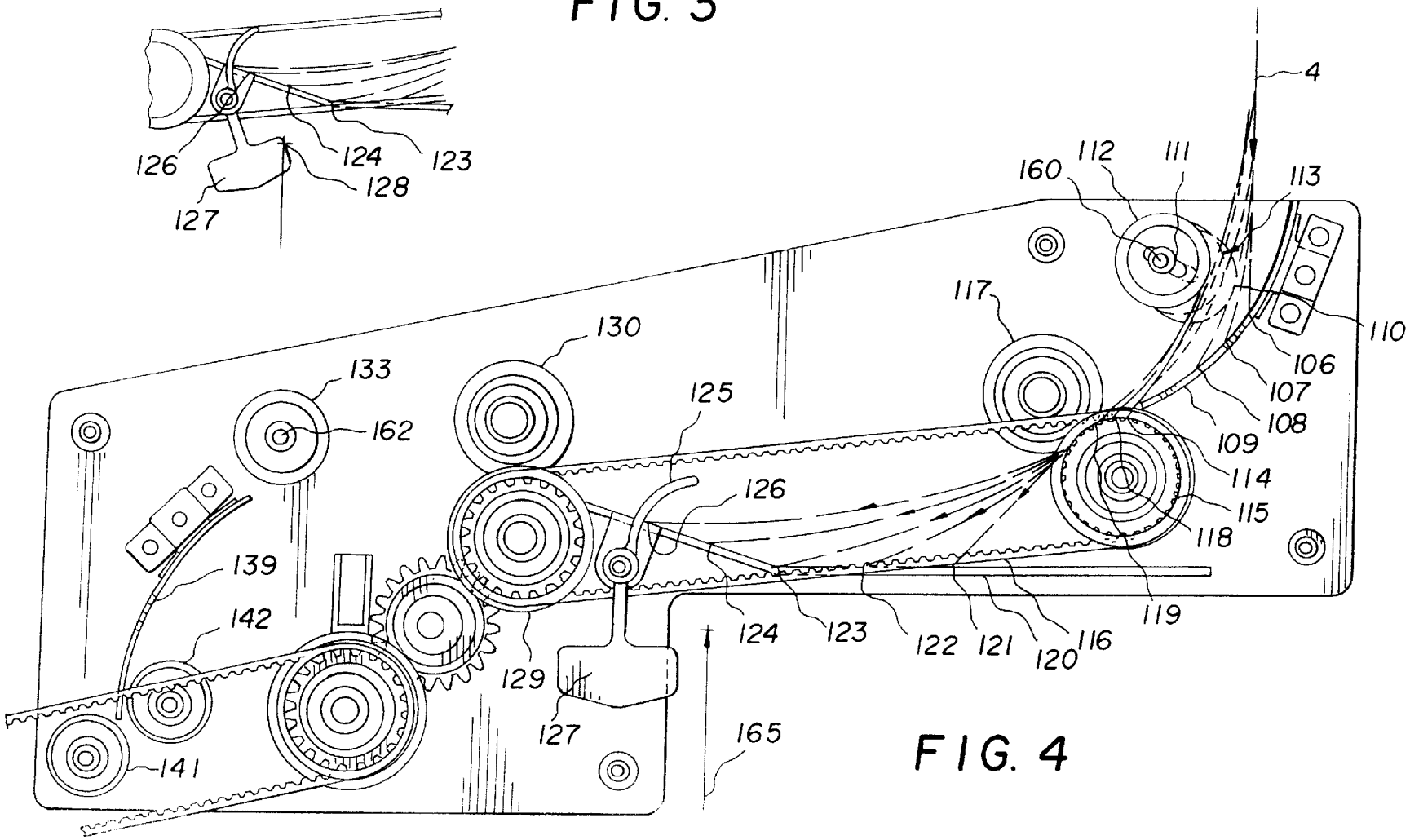
FIGS. 3, 4, and 5 are elevational, diagrammatic views of the embodiment of FIG. 2 useful in illustrating the present invention.

Referring to FIGS. 3 and 4, there is illustrated the incremental advance of film 22 into the shock absorbing and transfer portions of mechanism 32. In the shock absorbing section 113, the leading edge of film 22 is shown at incremental positions 106, 107, and 108, as is urged by film guide shoe 109. At position 108, film 22 engages puck roller 110. The puck roller 110 is composed of a number of soft foam puck rollers 110 positioned along a steel shaft 160. As the film 22 continues to advance to position 114 on drive roller 115, film 22 pushes the puck roller 110 up the inclined slot 111 to position 112, thereby transferring some of its kinetic energy to the puck roller 110. On striking roller 115 at position 114, the film 22 flexes, transferring its remaining kinetic energy into potential energy flexed film. As the film 22 flexes, the puck roller 110 drops back down slot 111, dissipating its energy as it strikes the bottom of slot 111. The film 22 then springs back up pushing the puck roller 110 part way up slot 111 to a final rest position. This energy transfer mechanism ensures that the film 22 does not bounce when it lands on roller 115.

The leading edge of film 22 is urged at position 118 by the drive roller 115 into first nip 119 between the drive roller 115 and the pressure roller 117 to register the film. The leading edge of film 22 exits from the first nip rollers 115,117 and lands at position 121 on the film guide 120. The leading edge of film 32 continues to move forward and being guided through positions 122, 123, and 124 with respectively film sensitive to scratch, engage the film path sensor actuator 125 at 126.

FIG. 3, there is illustrated leading edge of film actuating film path sensor flag 127, to the trigger point 128, of the optical film path sensor 165.

Figure 5:
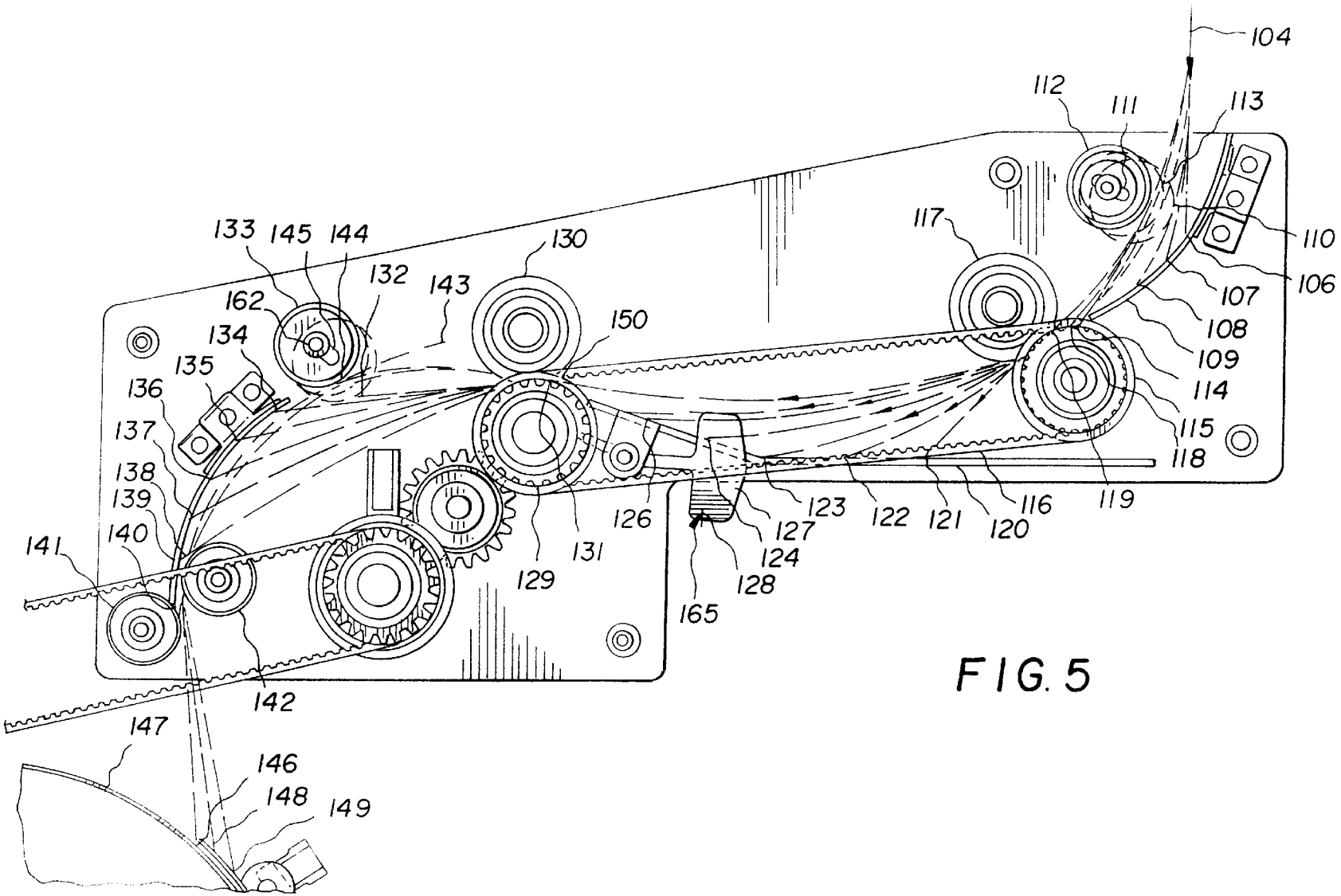

FIG. 5 shows the leading edge of the film moving through second nip rollers 131, composed of drive roller 129, and pressure roller 130. When the leading edge of the film reaches position 132, it strikes puck rollers 133 arranged on shaft 162 in inclined slot 145. The puck rollers 133 applies pressure to the film leading edge moving it towards the film guide shoe 139 through positions 134, 135, 136, 137, 138, and 140 to idler rollers 141 and 142, and then to the main drum surface 147 at points 146, 148, and into main drum first nip 149.

After trail edge of film 22 releases flag sensor 127, it rotates back to center gravity position (FIGS. 3 and 4) and disengages clutch 151.

The invention has been described in detail with particular reference to certain preferred embodiments thereof, but it will be understood that variations and modifications can be effected within the spirit and scope of the invention.

PARTS LIST

10 apparatus
12 laser printer
13 printer housing
14 processor
16 laser scanner
18,20 supplies
22 photothermographic film
24 slow scan drum
26 film path
28 control
30 memory
32 printer/processor film registration and transfer mechanism
34 drum
36 lamp
38 hold-down rollers
40 film cooling assembly
42 densitometer
44 directional arrow
46 output tray
51 electric clutch
52 timing belt
53,54,55 gears
57,58 pulleys
58 driven timing belt
106,107,108 incremental positions
109 film guide shoe
110 puck rollers
111 inclined slot
112 position
113 shock absorbing section
114 position
115 drive roller
117 pressure roller
118 position
119 film registration nip
120 film guide
121 position
122,123,124 guided positions
125,126 film sensor actuator
127 film path sensor flag
128 trigger point
129 drive roller
130 pressure roller
131 second nip rollers
132 position
133 puck roller
134,135,136,137,138 positions
139 film guide shoe
140 position
141,142 idler rollers
146,148 points
147 main drum surface
149 main drum first nip
145 inclined slot
151 clutch
160 steel shaft
161 nip
162 shaft
165 optical film path sensor

What is claimed is:

1. In a laser imaging system including a laser printer for exposing photothermographic sheet film to a medical image and a coupled thermal processor for thermally processing exposed photothermographic film, said processor having a thermal processing section wherein said film has dynamic energy as it is moved along a path between said printer and said processor, a sheet film registration and transfer mechanism comprising:

a first film shock absorbing and deflector mechanism for absorbing said energy of exposed film as it moves vertically out of said printer and for then deflecting said film substantially horizontally;

a film transfer mechanism for transferring said film between said printer and said processor along a substantially horizontal path; and a second film shock absorbing and deflector mechanism for absorbing said energy of said film as it is transferred along said horizontal path and for deflecting said film substantially vertically into the thermal processing section of said processor;

wherein said first and second mechanisms are passive and do not impart dynamic energy to sheet film moved along said path.

2. The mechanism of claim I wherein said film has a leading edge and wherein said first film shock absorbing mechanism includes a first plurality of slidably mounted puck rollers, such that engagement of said leading edge of a film with said first plurality of puck rollers causes said puck rollers to be moved upwardly against gravity, thereby dissipating the dynamic energy of said vertically moving film.

3. The mechanism of claim 1 wherein said film transfer mechanism includes spaced pairs of rollers which register said film and move said film horizontally into said second mechanism.

4. The mechanism of claim 1 wherein said film has a leading edge and wherein said second film shock absorbing mechanism includes a second plurality of puck rollers, such that engagement of said leading edge of said film with said second plurality of puck rollers causes said second plurality of puck rollers to be moved upwardly against gravity, thereby deflecting said film downwardly into said deflector to guide said film into said thermal processing section.

* * * * *